United States Patent [19]

Burany et al.

[11] Patent Number: 5,053,076

[45] Date of Patent: Oct. 1, 1991

[54] PROCESS AND DEVICE FOR REMOVAL OF ARSENIC, TIN & ARTIMONY FROM CRUDE LEAD CONTAINING SILVER

[75] Inventors: Peter Burany, Butjadingen; Juan J. von Lücken; Bernhard Hendriks, both of Nordenham, all of Fed. Rep. of Germany

[73] Assignee: Metaleurop Weser Blei GmbH, Nordenham, Fed. Rep. of Germany

[21] Appl. No.: 495,278

[22] Filed: Mar. 16, 1990

[51] Int. Cl.[5] ..... C22B 13/06; F27D 3/15

[52] U.S. Cl. ..... 75/699; 266/217; 266/225; 266/227; 266/236

[58] Field of Search ..... 75/699; 266/217, 225, 266/227, 236

[56] References Cited

U.S. PATENT DOCUMENTS 2,067,394 1/1937 Hall ..... 266/217

2,076,800 4/1937 Thummel ..... 75/699

2,113,643 4/1938 Betterton et al. ..... 75/700

*Primary Examiner*—Melvyn J. Andrews

*Attorney, Agent, or Firm*—Lockwood, Alex, Fitzgibbon & Cummings

[57] ABSTRACT

A process and device for the removal of arsenic, tin and antimony from crude lead by industrial oxygen is disclosed in which the oxygen is introduced into a turbulent fluid stream of lead restricted in a limited volume. The oxygen containing fluid stream passes into a larger volume in which the compounds which are to be separated float on the surface in the form of oxides and run off from the surface. The device includes two cylinders of different volume and one within the other. The cylinders are immersed at different depths in molten lead in the smelting crucible, a steam of fluid lead is introduced in the smaller cylinder by a lead pump and oxygen is introduced into this fluid lead stream.

14 Claims, 1 Drawing Sheet

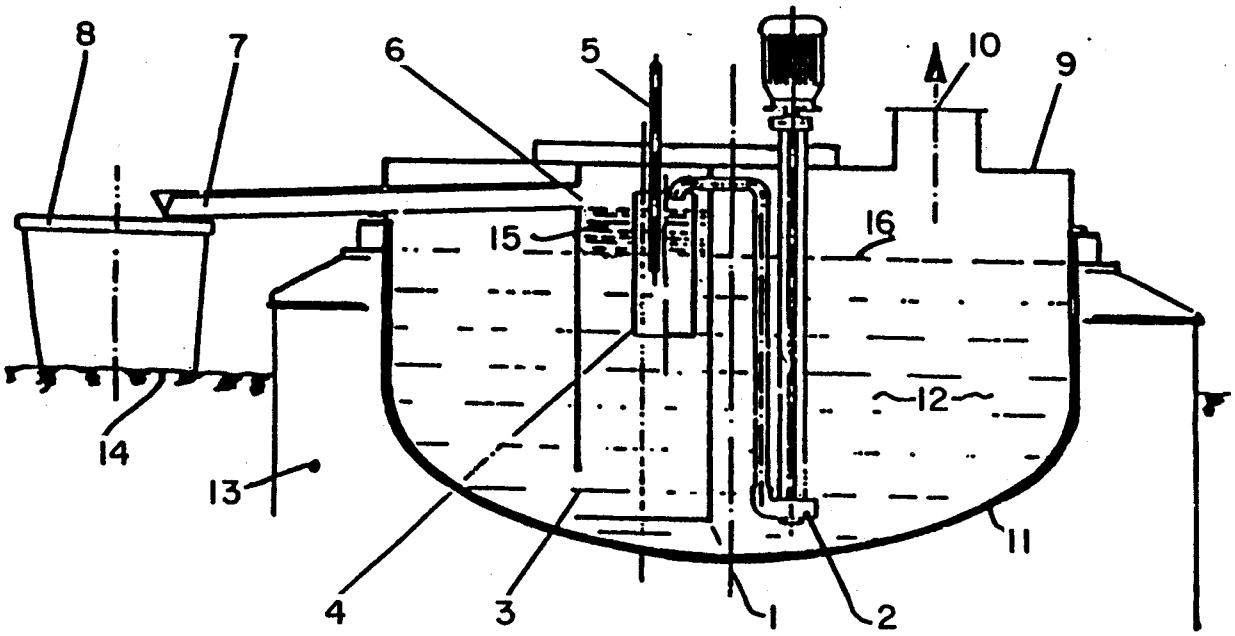
1
2
3
4
5
6
7
8
9
10
11
12
13
14
15
16

PROCESS AND DEVICE FOR REMOVAL OF ARSENIC, TIN & ARTIMONY FROM CRUDE LEAD CONTAINING SILVER

BACKGROUND AND DESCRIPTION OF THE INVENTION

This invention relates to a process for the removal of arsenic, tin and antimony from crude lead containing silver by means of industrial oxygen in a lead smelting crucible, and a device for the execution of the process.

The removal of tin, arsenic and antimony from crude lead containing silver is presently carried out in lead matallurgy in accordance with either the Harris process or the reverberatory process.

The Harris process (Ullmann, 3rd edition, volume 4, pages 498–501) is used, along with the separation of tin, arsenic and antimony, for the processing of tin-rich and/or tellurium-rich lead, whereby valuable final products accumulate which are in part highly concentrateo. The separation of the above-stated impurities from the crude lead takes place with sodium hydroxide and a strong oxidizing agent, preferably saltpeter, forming $Na_3SbO_4$, $Na_3AsO_4$ and $Na_2SnO_3$ which accumulate in the form of a fluid salt slag. The impurities removed from the crude lead subsequently must be separated from the salt slag into concentrateo and lead-free products by means of hydrometallurgic processes. The processing of the salt slags, which is the actual nucleus of the Harris process, requires extensive equipment and thus correspondingly high installation costs. The process is also expensive and requires careful monitoring. For these reasons the Harris process has not yet become widely prevalent in most lead smelting plants.

In the more widely used reverberatory furnace process (Ullmann, 3rd edition, volume 4, pages 498–501), the antimony along with the arsenic and tin, is oxidized at 700–750° C. by means of atmospheric oxygen. For this purpose, rectangular reverberatory or refining furnaces are used and the exhaust gasses, after the temperature has dropped, are conveyed in a cooling unit to a filter for removing dust. The air, which is blown in through lance units into the lead bath, oxidizes the tin, arsenic and antimony in that sequence forming double oxides which are removed from the furnace as fluid dross. Depending on whether a continuous or discontinuous operation is used, drosses of 8–25% Sb, 1–5% As and 30–50 ppm Ag are produced. In a continuous reverberatory furnace process which is characterized by its high conversion rate, drosses with only 8–13% Sb result. The low antimony content leads to correspondingly high dross quantities resulting in increased processing costs. The drosses are additionally processed by means of reduction melting into an alloy containing antimony and lead which is termed "crude hard lead", and from which hard lead qualities of commercially conventional quality are produced by means of subsequent refining.

The above-stated processes are characterized by high equipment expenses, such as for example, the processing of salt slags in the Harris process, and the cooling unit, dust removal filter, reserve furnaces and soon in the reverberatory furnace process. They are also characterized by a high energy consumption for the processing of large quantities of intermediate products, such as salt slags and drosses, as well as by high operating costs.

Modern processes in both primary as well as secondary lead smelting works for the separation of tin, arsenic and antimony from crude lead use oxygen/air mixtures in a conventional lead smelting crucible. In secondary lead smelting plants the drosses can be processed without problem because the crude lead of the secondary lead smelting plants has only a very low silver content (<30 g Ag/t). In a primary lead smelting plant in which a crude lead containing a silver content of up to several thousand g Ag/t is similarly processed, a dross is produced with 3.85% arsenic, 3.25% antimony and 1098 g/t of silver. See Proceedings of the CIM Symposium on "Quality in Non-Ferrous Pyrometalllurgical Processes", Vancouver [1985], pages 137–140. During the subsequent reduction of the dross, the silver contained therein moves into the hard lead from which it can not be removed, resulting in a corresponding loss of valuable metal. Furthermore, the hard lead which contains silver can not be marketed as commercial hard lead because the silver exceeds the permitted limits. Thus, this method can only be carried out in primary lead smelters which process crude lead containing silver if, before the reduction to crude hard lead, the dross is separated in a separate process step by liquation into an Ag-poor dross and Ag-rich crude lead. The liquation process is carried out for example in a short-drum rotary furnace or in a liquation hearth furnace. Because of the additional expense of liquation, the advantage of the crucible refining is considerably reduced.

Thus, it is clear that crucible refining by means of air enriched with oxygen can only be carried out economically, if the silver contents in the crude lead are very low, such as for example during the refining of scrap lead in accordance with DE-PS 3 332 796 which must be operated at temperatures of at least 630° C.

The task of the present invention is to describe a device and a process which avoid the above-stated disadvantages, such as for example crosses containing silver, additional consumption of reagents, higher operating temperature, etc., during refining in the lead smelting crucible, and in which the removal of tin, arsenic and antimony is carried out through the use of industrial oxygen in a conventional lead smelting crucible.

This task is solved in the process of the type described above, by introducing oxygen into a turbulent stream of fluid lead which is constricted to a proportionate volume relative to the smelting crucible. With such introduction the lead, thoroughly mixed with oxygen, enters into a larger volume for the purpose of calming, and the elements which are to be separated off float on the surface in the form of oxides and are skimmed off.

The process is carried out in a device which comprises two cylinders of different volumes. The cylinders are positioned perpendicularly to one another, can be adjusted relative to one another, and they project out above the surface of the molten mass. The cylinders are suspended on a traverse unit and the entire smelting crucible is covered by a protective hood. The turbulent stream of the lead is produced by means of lead pump, the discharge opening of the pressure side of which lies above the level of the lead. The turbulence in the small cylinder can also be produced below the level of the lead by means of a nozzle shaped discharge from the pump.

BRIEF DESCRIPTION OF DRAWING

The FIGURE shows a device constructed in accordance with the invention and For performing the process of the invention in schematic cross-section.

DESCRIPTION OF THE PREFERRED EMBODIMENT

The device employed for execution of the process in accordance with the invention is of cylindrical shape and connected with a lead pump 2. It essentially comprises a sheet steel cylinder 1 the lower portion of which is immersed in a lead bath 12 of the lead smelting crucible. The cylinder 1 and the lead pump 2 form a portable unit which, together with a traverse unit, is placed on the edge of the crucible. In use the lead moves out of the crucible through an opening 3 in the lower portion of the cylinder 1 and fills the crucible. By means of the lead pump 2, the lead is pumped out of the crucible into a reaction tube 4 in the form of a small cylinder which is located within the cylinder 1. The reaction tube is attached vertically and adjustably to the wall of the cylinder 1 and is immersed for approximately two thirds of its overall length into the lead bath located in the cylinder 1. The lead moving into the reaction tube vertically from the top subsequently flows at reduced speed through the cylinder 1 and flows back through the opening 3 located at the base of the cylinder into the lead smelting crucible.

Industrial oxygen is blown into the reaction tube through a lance unit 5. The oxygen and the lead are thoroughly mixed by means of the strongly turbulent current. The oxygen is entrained in the lead bath of the cylinder 1 and due to the good dispersion a rapid oxidation primarily of the secondary metals takes place. In the cylinder 1, the current is slowed down enough so that the fluid dross 15 separates from the lead on the basis of the differences in density, collects on the surface 16 of the bath of the cylinder, and is able to flow off through the tap hole 6 in the cylinder wall, through a channel 7, and into the crucible bowl 8. The crucible remains continuously covered by means of a protective hood 9 which is connected by means of suction piping 10 with a dust-removal device. The process can be carried out discontinuously, semi-continuously or continuously.

The invention will now be illustrated in grater detail to follow by means of two examples of execution.

EXAMPLE 1

150,000 kg of decoppered crude lead containing 0.8% Sb, 0.05% As and 1,500 g/t Ag were refined by means of industrial oxygen in a crucible at an initial temperature of 580° C., in accordance with the invention described. After one hour, the dross began to run off into a crucible bowl. After 300 minutes, a sample showed that the antimony and arsenic had been removed. The final temperature was 610° C. and the oxygen consumption was 210 $Nm^3$. 3,400 kg of dross, with 30.2% Sb, 2.0% As and 9 g/t Ag, were produced.

EXAMPLE 2

In a smelting works, the Sn-As-Sb removal is controlled in accordance with the reverberatory furnace process and replaced by means of the proposed process and apparatus, by means of which the entirety of the first runnings of the crude lead is now refined in a problem-free manner. The smelting crucibles provided for furnace refining were sufficient for the purpose of crucible refining so that, apart from the simple refining apparatus in accordance with the invention, no additional equipment expense was necessary.

The following characteristic process data were determined by the process in accordance with the invention:

1. The heating energy consumption, with refining output remaining the same, dropped by 58 kWh/t.

2. Because of the qualities of cooling water and compressed air not required in contrast with the reverberatory furnace process, as well as the elimination of the cooling of the exhaust gas, and the reduction of the exhaust gas volume, it was possible to reduce the consumption of power (including that for the oxygen production) by 2.3 kWh/t of crude lead. Starting from a crude lead with an average of 0.8% antimony and 0.05% arsenic, the dross accumulation is reduced relative to the reverberatory furnace process, from 45 kg dross per ton of crude lead to 26 kg dross/t of crude lead, s that during the further processing of the dross with hard lead, 15 kWh/t of crude lead in reduction energy, 6 kWh/t of crude lead in reduction energy and 6 kWh/t of crude lead in heating energy were saved.

3. With first runnings of crude lead, for example of 120,000 t/year, an energy savings of approximately 9,760,000 kWh/year resulted. By means of this method the disadvantages of refining furnaces, including the removal of exhaust gas dust, is eliminated resulting in operating costs which are markedly reduced together with a considerable reduction of harmful effects on the atmosphere.

4. Since the dross arising in this method has a low melting point because of the absence of portions of additives, such as for example lime or sodium hydroxide, and because smaller quantities of slag accumulate, the further processing is more cost-effective.

What is claimed is:

1. A process for the removal of As, Sn and Sb from crude lead from molten lead in a smelting crucible comprising:

introducing fluid lead into a volume which is constricted in size relative to the volume of molten lead in the crucible to produce a turbulent flow of the fluid lead in the constricted volume;

introducing oxygen into the turbulent flow of fluid lead in the constricted volume to thoroughly mix the oxygen with the fluid lead;

calming the fluid lead by passing it to a larger volume;

floating the oxides so formed to the surface of the fluid lead in the larger volume; and removing the floating oxides from said surface.

2. The process of claim 1, .wherein the oxygen is introduced near the location of introduction of the fluid lead.

3. The process of claim 2, wherein the oxygen is industrial oxygen.

4. The process of claim 1, wherein the oxygen is industrial oxygen.

5. A device for positioning in a smelting crucible for the removal of As, Sn and Sb from molten crude lead in the crucible the latter of which contains the molten crude lead so as to define a surface on the molten crude lead, comprising:

a first cylinder of a given volume for positioning in the crucible in the molten crude lead;

a second cylinder of a lesser volume positioned within said first cylinder and in the molten crude lead, both of said cylinders extending above the surface of the molten crude lead in the crucible when said cylinders are positioned in the crucible;

means for introducing a flow of fluid molten crude lead from the crucible into said second cylinder when said cylinders are positioned in the crucible to produce a turbulent flow of fluid lead in said second cylinder;

means for introducing oxygen into the turbulent flow of fluid lead in said second cylinder;

means for communicating the oxygen containing fluid lead from said second cylinder to said first cylinder to calm the fluid lead; and means for removing the oxides formed by the oxygen from the surface of the fluid lead in the first cylinder.

6. The device of claim 5, wherein said means for introducing molten crude lead and said means for introducing oxygen are adjacent each other.

7. The device of claim 5, wherein said cylinders are adjustable relative to each other.

8. The device of claim 5 including said crucible; a protective hood on said crucible; said first and second cylinders are suspended in said crucible; and said first cylinder includes a discharge opening communicating the lead in said first cylinder with the molten crude lead in said crucible.

9. The device of claim 8, wherein said means for introducing molten crude lead and said means for introducing oxygen are adjacent each other.

10. The device of claim 8, wherein said cylinders are adjustable relative to each other.

11. The device of claim 5, wherein said means for introducing the molten crude lead comprises a lead pump, said lead pump having a discharge above the surface of the molten crude lead in said second cylinder.

12. The device of claim 8, wherein said means for introducing the molten crude lead comprises a lead pump, said lead pump having a discharge above the surface of the molten crude lead in said second cylinder.

13. The device of claim 12, wherein said means for introducing molten crude lead and said means for introducing oxygen are adjacent each other.

14. The device of claim 12, wherein said cylinders are adjustable relative to each other.

* * * * *

UNITED STATES PATENT AND TRADEMARK OFFICE

CERTIFICATE OF CORRECTION

PATENT NO. : 5,053,076

DATED : October 1, 1991

INVENTOR(S) : Peter Burany, Juan J. von Lucken, Bernhard Hendriks

It is certified that error appears in the above-identified patent and that said Letters Patent is hereby corrected as shown below:

In column 1, line 27, delete "concentrateo" and insert -- concentrated --.

In column 1, line 62, delete "soon" and insert -- so on --.

In column 3, line 4, delete "For" and insert -- for --.

In column 4, line 20, delete "s" and insert -- so --.

Signed and Sealed this

Fourteenth Day of June, 1994

*Attest:*

Bruce Lehman

BRUCE LEHMAN

*Attesting Officer*

*Commissioner of Patents and Trademarks*